United States Patent [19]

Bush

[11] Patent Number: 5,007,368

[45] Date of Patent: Apr. 16, 1991

[54] EMERGENCY SKI ALTERING DEVICE AND METHOD

[76] Inventor: Timothy P. Bush, 9 Bayberry Dr., Tuckerton, N.J. 08087

[21] Appl. No.: 484,256

[22] Filed: Feb. 26, 1990

[51] Int. Cl.[5] ..... G08B 1/00

[52] U.S. Cl. ..... 116/211; 116/209

[58] Field of Search ..... 116/211, 209; 141/17, 141/19, 329, 330; 102/513; 42/1.15, 1.08, 1.14; 124/74, 73, 71, 57; 222/23, 5; 220/375, 268, 269

[56] References Cited

U.S. PATENT DOCUMENTS

| | | | |
|---|---|---|---|
| 2,350,717 | 6/1944 | Blair . | |
| 2,375,314 | 5/1945 | Mills | 42/1.15 |
| 2,675,776 | 4/1954 | Tuve | 116/211 |
| 3,044,360 | 7/1962 | Stefan et al. . | |
| 3,432,857 | 3/1969 | Rasmussen et al. | 42/1.15 |
| 3,460,507 | 8/1969 | Little et al. | 116/211 |
| 3,612,857 | 10/1971 | Beatty et al. . | |
| 3,670,692 | 6/1972 | Jackson | 116/211 |
| 4,080,677 | 3/1978 | Koehler . | |
| 4,114,561 | 9/1978 | Asaro . | |
| 4,376,421 | 3/1983 | Skinner | 116/211 |
| 4,534,070 | 8/1985 | Hauptmann et al. | 116/227 |
| 4,644,930 | 2/1987 | Mainhardt . | |
| 4,844,250 | 7/1989 | Holoubek et al. | 215/318 |
| 4,867,209 | 9/1989 | Santoiemmo | 141/19 |

*Primary Examiner*—William A. Cuchlinski, Jr.
*Assistant Examiner*—Daniel G. DePumpo
*Attorney, Agent, or Firm*—Thomas A. Lennox

[57] ABSTRACT

A compressed gas powered projection device is provided to alert other skiers of a downed skier who is incapacitated in the snow including a projection cartridge containing liquid to disperse into droplets as the cartridge is projected through the air. The opening to the cartridge is opened prior to or at the time of projection to sprinkle the liquid on the snow leaving brightly colored marks.

31 Claims, 2 Drawing Sheets

EMERGENCY SKI ALTERING DEVICE AND METHOD

BACKGROUND OF THE INVENTION

Snow skiing is an extremely popular and ever-growing sport. It has the advantage that it can be done in groups of people, or a person can virtually go off alone and ski enjoying the outdoors and communing with nature. While skiing is extremely exhilarating it can be quite exciting particularly on the more advanced slopes. Despite efforts to make the sport safe, there remains a significant risk that the person will fall during the descent and that the fall might be at any time and in any place.

Many of the larger ski resorts have fifty to a hundred separate trails. These trails are carved out of the woods and vary from the beginning slopes to the most advanced slopes. Many times there are portions of these trails that are completely hidden from other trails and certainly from the resort building structures at the bottom of the hill. It is recommended that persons travel in pairs and that they ski down the same trails together. However, because of varying abilities, and because some persons wish to go out alone, it is not uncommon for a single person to be on a trial, sometimes with no one else around. This typically might be early in the morning or late in the afternoon as the sun sets. Some of the more advanced trails are relatively narrow and if a skier loses control he or she may well essentially "fly" off the trail and into the underbrush. In many cases, where there has been heavy snowfall, the snow can be quite deep and unpacked off the trail. If the person is injured either by the fall or as a result of striking a tree, he or she may not be able to get back to the trail, particularly out of heavy snow drifts. If the person cannot release the bindings, it can be virtually impossible to get out of the deep snow unless the skis can be released. Each year, there are a number of skiers that are lost in this fashion and suffer from exposure, sometimes resulting in death. The problem arises that when the person shows up missing, it is virtually impossible to locate that person if he or she is off the trail and in the brush or woods. Unless the search is successful, the person might stay there overnight and perish.

While a number of devices have been provided for persons lost in open water, none of these devices are applicable or satisfy the needs of a person lost off the trail in the snow. These devices do not satisfy the needs described herein above nor attain the objects described herein below.

SUMMARY OF THE INVENTION

The invention includes a device and method which allows an incapacitated skier to alert other skiers to the skier's need for help and to aid in locating the incapacitated skier. The incapacitated skier has fallen and, in the process, become incapacitated such that he or she is unable to rise and get out of the deep snow and back to the trail. The device is used to signal to other skiers as to the location of the downed skier. This is accomplished by marking the snow with a highly visible mark carried by a liquid, such as a red or green dye in a line from the downed skier to an area where skiers are likely to see and observe markings on the snow. Thus, the downed skier, using the device of this invention, projects a cartridge that sprinkles colored dye over the surface of the snow essentially the full length of the travel of the cartridge through the air. As the cartridge loses momentum and angles toward the ground, more liquid is sprinkled outwardly on the snow such that a more intense and wider pattern is made. Finally, any marking liquid leaking from the cartridge after it strikes the snow surface, will provide an extremely intense mark. The skiers, seeing such a marking, can easily follow the pattern along the snow which is aimed directly at the downed, incapacitated skier.

The invention is a device to alert other skiers of a downed skier that is incapacitated in the snow out of direct sight from the other skiers. The device includes a cartridge that includes an interior storage volume, an aperture to the interior storage volume, and a closure means to prevent inadvertent opening of the aperture prior to actuating the trigger means, and to be either openable just prior to actuating the trigger means or be openable as the cartridge is projected from the device. The device further includes a body that includes projection means to provide a source of power to project the cartridge from the body, and trigger means on the body to actuate the projection means. The device also includes a charge of liquid in the cartridge having physical characteristics to disperse from the aperture into droplets as the cartridge is projected through the air and to have high visibility when sprinkled over the snow.

It is preferred that the body have a front and a rear, and that the body include a hollow rear cavity, a front hollow barrel section with an opening to the front, wherein the projection means is in the rear cavity to provide a source of high pressure gas, and wherein the trigger means actuates release of the high pressure gas from the projection means, and communication means between the rear cavity and the front barrel section to allow gas flow from the rear cavity to the front barrel section. It is also preferred that the cartridge further include a rear section that includes a transverse cross-section of a size and shape sufficient to wedge into and air tightly close off the opening of the front hollow barrel section. It is further preferred that the closure means include adhesive tape. It is also preferred that the closure means include a strip of tape comprising removable contact adhesive on a first side proximate one end of the tape covering and sealing the aperture of a permanent attachment of the other end of the tape to the body. It is further preferred that the projection means include a pressurized carbon dioxide cartridge. It is also preferred that the projection means include a pressurized carbon dioxide cartridge held in the rear cavity against a seat proximate the rear of the rear cavity, and that the trigger means include a rearwardly pointed seal piercing member, and movement means to move the seat forwardly responsive to action by the person's hand. It is further preferred that the movement means include a rear portion of the rear section comprising the seat threadably engaged with the remaining portion of rear section, wherein twisting the rear portion engaged in the threads moves the rear position forwardly relative to the remainder of the rear section a sufficient distance to pierce the carbon dioxide cartridge with the seal piercing member. It is further preferred that the device further include a frangible stop to prevent inadvertent screwing of the closing cap. It is also preferred that the liquid include a mixture of an alcohol, water and a soluble red or green dye.

The invention is also a device that includes a body, having a front and a rear, the body including a hollow rear cavity, a front hollow barrel section with an opening to the front, projection means in the rear cavity to provide a source of high pressure gas, trigger means on the body to actuate release of the high pressure gas from the projection means, and communication means between the rear cavity and the front barrel section to allow gas flow from the rear cavity to the front barrel section. The device further includes a cartridge that includes an interior storage volume, a rear section comprising a transverse cross-section of a size and shape sufficient to wedge into and air tightly close off the opening of the front hollow barrel section, and a front section that includes an aperture to the interior storage volume, and a closure means to prevent inadvertent opening of the aperture prior to actuating the trigger means, and to be either openable just prior to actuating the trigger means or be openable as the cartridge is projected from the device. The device also includes a charge of liquid in the cartridge having physical characteristics to disperse from the aperture into droplets as the cartridge is projected through the air and to have high visibility when sprinkled on the snow.

The invention is also a method to alert other skiers of a downed skier that is incapacitated in the snow out of direct sight from the other skiers. The method includes placing a device in a storage location on the person of a skier before going out on a ski trail. The device is as described hereinabove. The method further includes the downed skier removing the device from its storage location on his or her person and aiming the device such that the direction of projection of the cartridge is upwardly and toward an area where other skiers travel and would likely see markings on the snow. The method also includes the downed skier actuating the trigger means to project the cartridge over the snow to sprinkle the high visibility liquid over the snow in a line from the downed skier to the area where other skiers travel. It is preferred that the projection means include a pressurized carbon dioxide cartridge held in the rear cavity against a seat proximate the rear of the rear cavity, the trigger means include a rearwardly pointed seal piercing member, and actuating the trigger means includes moving the seat forwardly responsive to action by the person's hand urging the carbon dioxide cartridge against piercing member to release the gas. It is also preferred that the moving of the rear seat includes twisting a rear portion the rear section that is threadably engaged with the remaining portion of rear section, wherein twisting the rear portion engaged in the threads moves the seat in the rear position forwardly relative to the piercing member a sufficient distance to pierce the carbon dioxide cartridge with the seal piercing member.

BRIEF DESCRIPTION OF THE DRAWINGS

FIG. 2A is a perspective view illustrating a second embodiment of the invention picturing an alternative mechanism on the front end of the cartridge.

DESCRIPTION OF PREFERRED EMBODIMENTS

Figure 1:
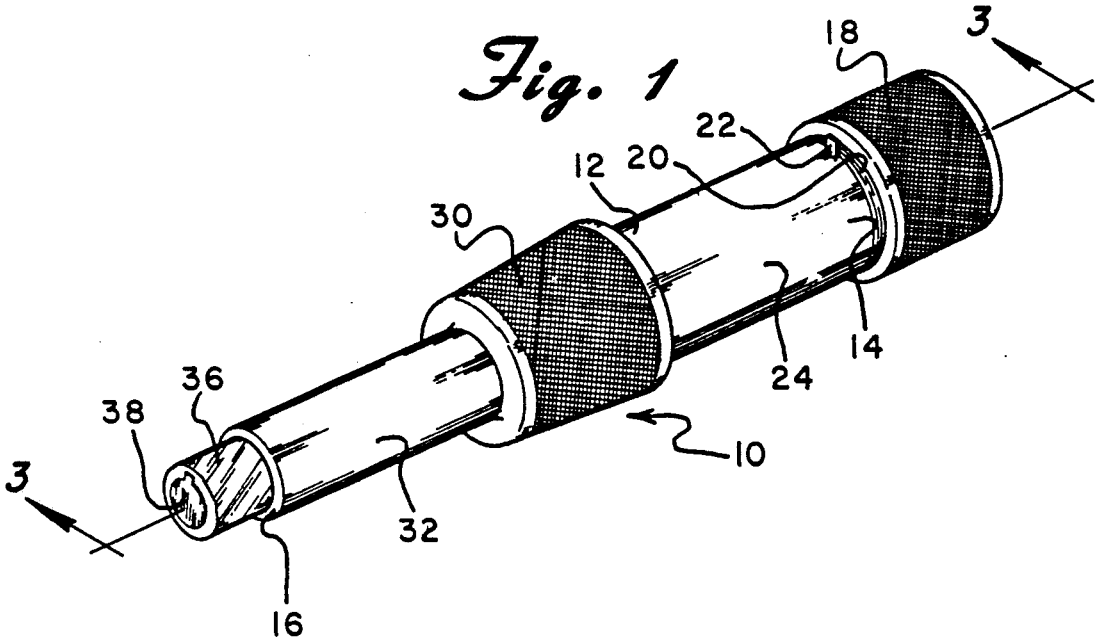
FIG. 1 is a perspective view of a device according to the present invention.
Figure 1A:
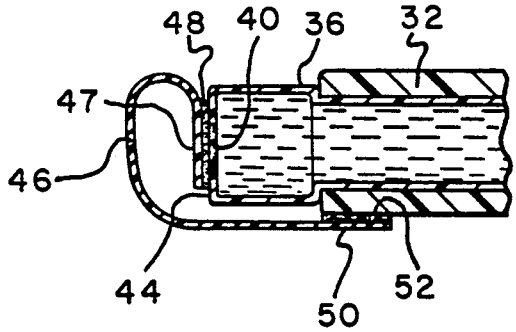
Figure 2:
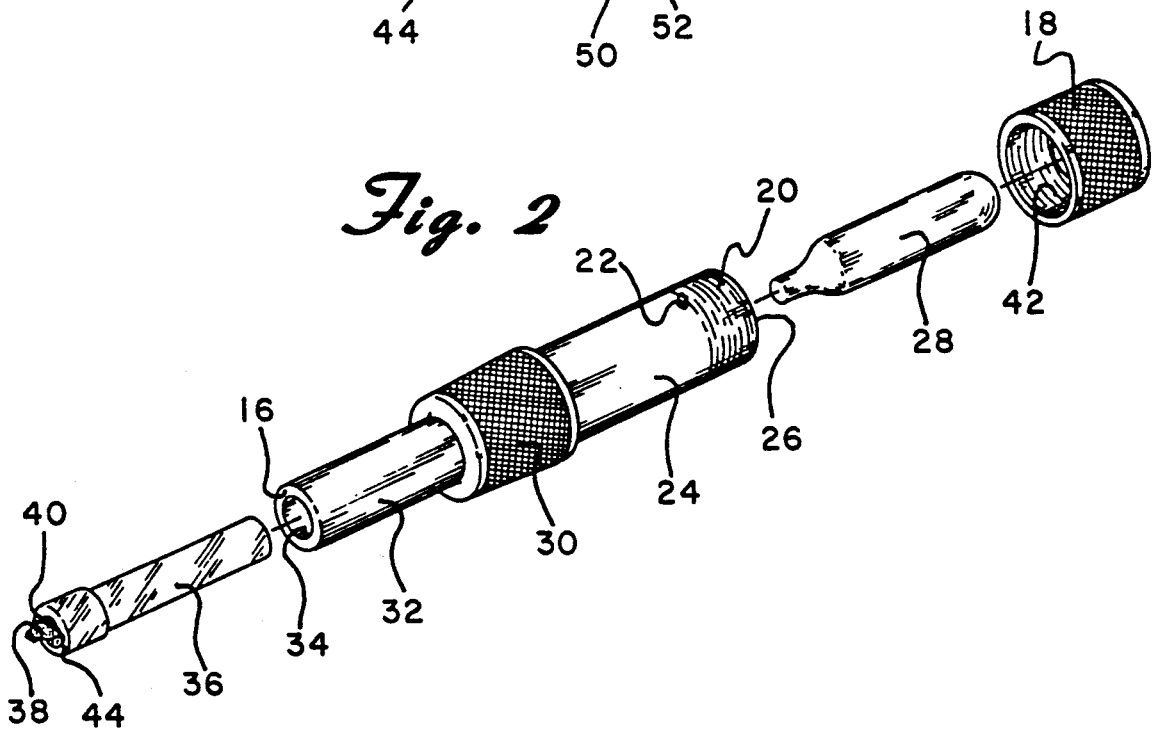
FIG. 2 is an exploded perspective view of the device illustrated in FIG. 1.

Device 10 of the present invention as illustrated in FIG. 1 is injection molded of an impact resistent thermoplastic polymer such as high density polyethylene, nylon, polycarbonate or other engineering plastic. Device 10 includes housing 12 which is generally cylindrical in shape having rear end 14 equipped with exterior positive threads 20 on which threaded end cap 18 closes off the rear end of device 10. The rear section of housing 12 includes rear section 24 which is a hollow body having a cavity therein. Intermediate along the length of housing 12 is raised hand hold section 30 which is intermediate between rear cavity section 24 and front hollow barrel section 32 extending forwardly to front end 16. As further illustrated in FIG. 2 wherein the individual parts are exploded apart, liquid cartridge 36 is wedged into cylindrical opening 34 through front end 16 of barrel 32. The size and shape of cartridge 16 molded of polyethylene is of a size and shape to wedge tightly into opening 34 as shown in FIG. 1. Adhesive tape closure 38 covers and closes aperture 40 at front end 44 of cartridge 36. Frangible stop 22 is molded into body 12 extending outwardly to prevent inadvertent screwing of end cap 18 past the stop. When device 10 is to be actuated, rear cap 18 is screwed hard enough to break off frangible stops 22 and exert pressure on carbon dioxide pressured cartridge 28 forwardly inside the cavity of rear section 24. This movement of cartridge 28 forwardly pierces carbon dioxide cartridge 28 releasing the pressurized gas which in turn projects cartridge 36 out the end of barrel 32. In this embodiment, as shown in FIG. 2, tape 38 has been partially pulled away to adjustably open aperture 40 such that when the device is actuated and cartridge 36 is projected through the air, the liquid sprinkles outwardly as the projectile flies through the air to leave a track on the snow. An alternate embodiment is illustrated in FIG. 2A wherein flexible plastic tape 46 is attached at end 47 through removable contact adhesive 44 to end 44 as a closure to seal off aperture 40 keeping the liquid in cartridge 32. Tape 46 is doubled back over itself and bent downwardly o the outside surface of barrel section 32 where the opposite side of tape 46 at end 50 is attached through permanent adhesive 52 to the outside surface of barrel 32. In this embodiment, it is not necessary for the user of the device to first remove the tape. The projection of cartridge 36 will disengage adhesive 48 from end 44 of cartridge 36 opening it in the process and allowing the liquid in the cartridge to sprinkle outwardly during the path of the cartridge through the air.

Figure 3:
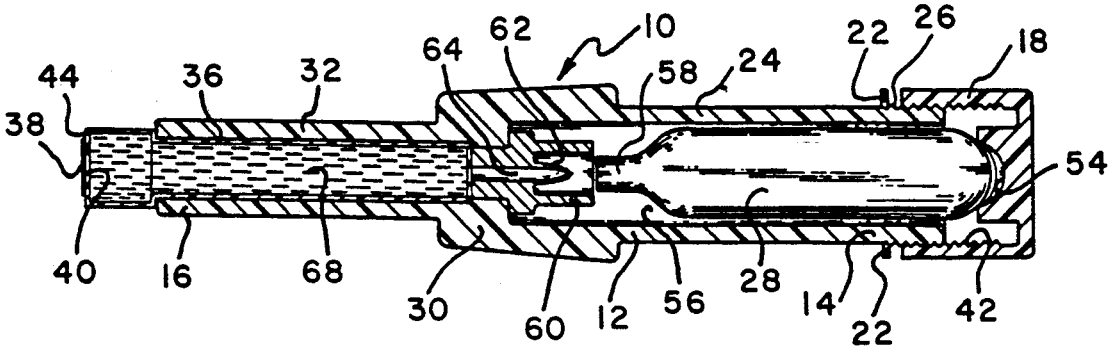
FIG. 3 is a longitudinal cross-sectional view taken along lines 3—3 of FIG. 1.
Figure 4:
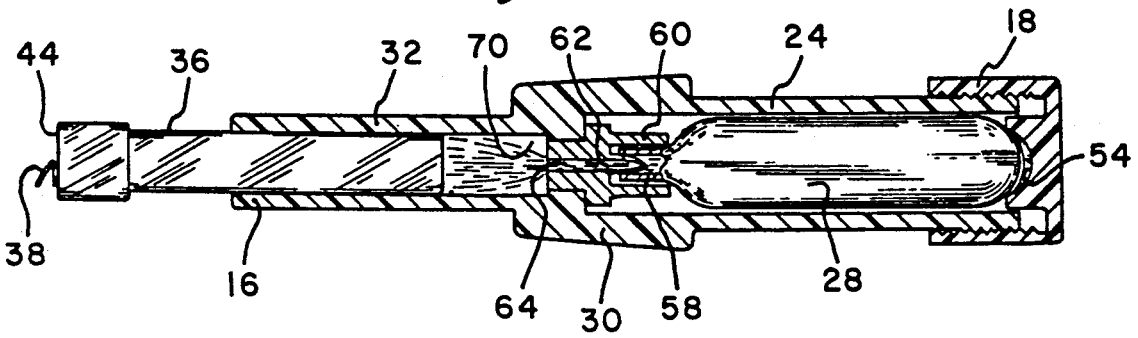
FIG. 4 is a schematic drawing using the cross-sectional view of FIG. 3 showing the shooting of the cartridge out of the device.

As more closely shown in FIGS. 3 and 4, the interior construction of device 10 includes rear seat 54 on the inside of threaded closure cap 18 which holds the rear end of carbon dioxide cylinder 28 inside cavity 56 of section 24 of housing 12. As shown in FIG. 3, cylinder 28 is held loosely in cavity 56 as cap 18 has not been screwed forwardly past frangible stops 22. Thus, front end 58 of cylinder 28 is resting well short of interior cylindrical guide 60 into which end 58 is insertable and engages when the device is to be actuated. Puncture device 62 is a sharp implement capable of piercing the soft metal seal on end 58 of cylinder 28. Puncture device 62 is a pointed hollow metal tube having longitudinal pathway 64 extending its full length and opening into the interior of barrel 32. Thus, as illustrated in FIG. 4 where front end 58 of cartridge 28 is partially cut away, puncture device 62 is shown piercing end 58 and opening the flow of pressurized carbon dioxide gas through tube 64 into chamber 70 of barrel 32 behind cartridge 36 to propel it out of the barrel and across the snow. Cap 18 has been screwed forwardly past frangible stops 22 forcing cylinder 28 forwardly into cylindrical guide 60 which houses puncture device 62 which, as cylinder 28 is pushed forwardly it enters guide 60 and punctures end 58 releasing the pressurized carbon dioxide gas. Liquid 68 in cartridge 36 is an ethyl alcohol water solution (15% alcohol by weight) with a soluble red or green dye having luminescent properties to be particularly visible when sprinkled on the snow. This dye may be luminescent such that it will tend to glow for some time thus aiding the location of skiers lost in the evening. The dye need not be soluble as a suspension of red or green particulate will also leave a highly visible mark on the snow and will not tend to disperse into melted snow as quickly.

An alternative embodiment of device 10 may be chosen if it is desired to reduce the packing length of the device. Instead of providing cap 18, the rear end of rear section 24 of housing 12 is closed off as a solid single molded piece. There is a separation between section 24 and band hold 30 such that the housing is in two pieces. Male threads are molded in the front end on the outside of section 24 and female threads are molded on the inside of hand held section 30. These threads are complimentary and section 24 can be threadably attached to section 30. Cylinder 28 is fixed inside section 24 and lock stops 22 would be moved forwardly on the outside of section 24 to provide a guide as to when cylinder 28 would be punctured. For this embodiment the two section can be packaged together side by side in a more compact package. When the device is to be used section 24 is screwed into section 30 until cylinder 28 is forced forwardly to puncture seal 58 and expel cartridge 36.

Figure 5:
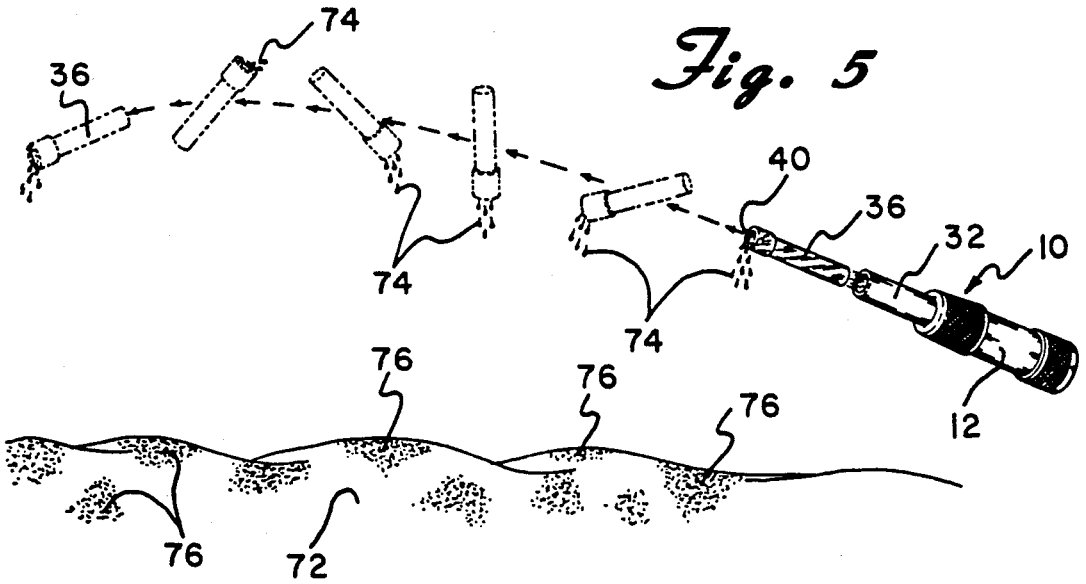
FIG. 5 is a perspective diagram showing the device illustrated in FIG. 1 held in the hand and ejecting the liquid container that tumbles through the air distributing dye on the snow under the path of the projectile.

The method of shooting device 10 is illustrated in FIG. 5. Body cylinder 12 is gripped aiming barrel 32 upwardly and in a direction toward an area on snow 72 where other skiers are likely to see the markings. As cartridge 36 is projected from barrel 32 drips 74 of liquid 68 escape opening 40 to reach snow 72 leaving drip markings 76 over the entire path of cartridge 36. The line from the area where other skiers travel is readily visible back to the source of the projectile, the downed skier.

While this invention has been described with reference to the specific embodiments disclosed herein, it is not confined to the details set forth and the patent is intended to include modifications and changes which may come within and extend from the following claims.

We claim:

1. A device to alert other skiers of a downed skier that is incapacitated in the snow out of direct sight from the other skiers, the device comprising:

(A) a cartridge comprising:

(i) an interior storage volume sufficient to store a charge of liquid, (ii) aperture means to provide an opening to the interior storage volume for continuously dispensing said charge of liquid from the cartridge as the cartridge is projected through the air, and (iii) a closure means to (a) prevent inadvertant opening of the aperture means prior to actuating the trigger means, and (b) be openable to permit dispensing of said charge of liquid from the opening of the cartridge, and (B) a body comprising:

(i) projection means to provide a source of power to project the cartridge from the body, and (ii) trigger means on the body to actuate the projection means, and (C) said charge of liquid in the cartridge having physical characteristics to disperse from the aperture means into droplets as the cartridge is projected through the air and to have high visibility when sprinkled on the snow.

2. The device of claim 1 wherein the body has a front and a rear, and the body comprises:

(a) a rear section housing a hollow rear cavity, (b) a front hollow barrel section with an opening to the front, wherein the projection means is in the rear cavity to provide a source of high pressure gas, and wherein the trigger means actuates release of the high pressure gas from the projection means, and (c) communication means between the rear cavity and the front barrel section to allow gas flow from the rear cavity to the front barrel section.

3. The device of claim 2 wherein the cartridge further comprises a rear section comprising a transverse cross-section of a size and shape sufficient to wedge into and air tightly close off the opening of the front hollow barrel section.

4. The device of claim 1 wherein the closure means comprises adhesive tape.

5. The device of claim 1 wherein the closure means is opened as a result of the cartridge being projected from the device.

6. The device of claim 5 wherein the closure means comprises a strip of tape comprising removable contact adhesive on a first side proximate one end of the tape covering and sealing the aperture means and a permanent attachment of the other end of the tape to the body.

7. The device of claim 1 wherein the projection means comprises a pressurized carbon dioxide cartridge.

8. The device of claim 2 wherein the projection means comprises a pressurized carbon dioxide cartridge held in the rear cavity against a seat proximate the rear of the rear cavity, and the trigger means comprises:

(a) a rearwardly pointed seal piercing member, and (b) movement means to move the seat forwardly responsive to action by the skier's hand.

9. The device of claim 8 wherein the movement means comprises a rear portion of the rear section comprising the seat threadably engaged with the remaining portion of rear section, wherein twisting the rear portion engaged in the threads moves the rear portion forwardly relative to the remainder of the rear section a sufficient distance to pierce the carbon dioxide cartridge with the seal piercing member.

10. The device of claim 9 wherein the device further comprises a frangible stop to prevent inadvertant screwing of the rear portion of the rear section.

11. The device of claim 1 wherein the liquid comprises a mixture of an alcohol, water and a soluble red or green dye.

12. A device to alert other skiers of a downed skier that is incapacitated out of direct sight from the other skiers, the device comprising:

(A) a body, having a front and a rear, the body comprising:
  (i) a rear section housing a hollow rear cavity,
  (ii) a front hollow barrel section with an opening to the front,
  (iii) projection means in the rear cavity to provide a source of high pressure gas,
  (iv) trigger means on the body to actuate release of the high pressure gas from the projection means, and
  (v) communication means between the rear cavity and the front barrel section to allow gas flow from the rear cavity to the front barrel section, (B) a cartridge comprising:
  (i) an interior storage volume sufficient to store a charge of liquid,
  (ii) a rear section comprising a transverse cross-section of a size and shape sufficient to wedge into and air tightly close off the opening of the front hollow barrel section, and
  (iii) a front section comprising:
    (a) aperture means to provide an opening to the interior storage volume for continuously dispensing said charge of liquid from the cartridge as the cartridge is projected through the air, and
    (b) a closure means to
      (1) prevent inadvertant opening of the aperture means prior to actuating the trigger means, and
      (2) be openable to permit dispensing of said charge of liquid from the opening of the cartridge, and (C) said charge of liquid in the cartridge having physical characteristics to disperse from the aperture means into droplets as the cartridge is projected through the air and to have high visibility when sprinkled on the snow.

13. The device of claim 12 wherein the closure means comprises adhesive tape.

14. The device of claim 12 wherein the closure means is opened as a result of the cartridge being projected from the device.

15. The device of claim 14 wherein the closure means comprises a strip of tape comprising removable contact adhesive on a first side proximate one end of the tape covering and sealing the aperture means and a permanent attachment of the other end of the tape to the body.

16. The device of claim 12 wherein the projection means comprises a pressurized carbon dioxide cartridge.

17. The device of claim 12 wherein the projection means comprises a pressurized carbon dioxide cartridge held in the rear cavity against a seat proximate the rear of the rear cavity, and the trigger means comprises:

(a) a rearwardly pointed seal piercing member, and
(b) movement means to move the seat forwardly responsive to action by the skier's hand.

18. The device of claim 17 wherein the movement means comprises a rear portion of the rear section comprising the seat, threadably engaged with the remaining portion of rear section, wherein twisting the rear portion engaged in the threads moves the rear portion forwardly relative to the remainder of the rear section a sufficient distance to pierce the carbon dioxide cartridge with the seal piercing member.

19. The device of claim 18 wherein the device further comprises a frangible stop to prevent inadvertant screwing of the rear portion.

20. The device of claim 12 wherein the liquid comprises a mixture of an alcohol, water and a soluble red or green dye.

21. A method to alert other skiers of a downed skier that is incapacitated in the snow out of direct sight from the other skiers, the method comprising:

(A) placing a device in a storage location on the person of a skier before going out on a ski trail, the device comprising:
  (1) a cartridge comprising:
    (i) an interior storage volume sufficient to store a charge of liquid,
    (ii) aperture means to provide an opening to the interior storage volume for continuously dispensing said charge of liquid from the cartridge as the cartridge is projected through the air, and
    (iii) a closure means to
      (a) prevent inadvertant opening of the aperture means prior to actuating trigger means, and
      (b) be openable to permit dispensing of said charge of liquid from the opening of the cartridge, and
  (2) a body comprising:
    (i) projection means to provide a source of power to project the cartridge from the body, and
    (ii) trigger means on the body to actuate the projection means, and
  (3) a charge of liquid in the cartridge having physical characteristics to disperse from the aperture into droplets as the cartridge is projected through the air and to have high visibility when sprinkled on the snow (B) the downed skier removing the device from its storage location on his or her person, (C) the downed skier aiming the device such that the direction of projection of the cartridge is upwardly and toward an area where other skiers travel and would likely see markings on the snow, (D) the downed skier actuating the trigger means to project the cartridge over the snow to sprinkle the high visibility liquid over the snow in a line from the downed skier to the area where other skiers travel.

22. The method of claim 21 wherein the body has a front and a rear, and the body comprises:

(a) a rear section housing a hollow rear cavity,
(b) a front hollow barrel section with an opening to the front, wherein the projection means is in the rear cavity to provide a source of high pressure gas, and wherein the trigger means actuates release of the high pressure gas from the projection means, and (c) communication means between the rear cavity and the front barrel section to allow gas flow from the rear cavity to the front barrel section.

23. The method of claim 21 wherein the cartridge further comprises a rear section comprising a transverse cross-section of a size and shape sufficient to wedge into and air tightly close off the opening of the front hollow barrel section.

24. The method of claim 21 wherein the closure means comprises adhesive tape.

25. The method of claim 21 wherein the closure means is opened as a result of the cartridge being projected from the device.

26. The method of claim 25 wherein the closure means comprises a strip of tape comprising removable contact adhesive on a first side proximate one end of the tape covering and sealing the aperture means and a permanent attachment of the other end of the tape to the body.

27. The method of claim 21 wherein the projection means comprises a pressurized carbon dioxide cartridge.

28. The method of claim 21 wherein the projection means comprises a pressurized carbon dioxide cartridge held in the rear cavity against a seat proximate the rear of the rear cavity, the trigger means comprises a rearwardly pointed seal piercing member, and actuating the trigger means comprises moving the seat forwardly responsive to action by the skier's hand urging the carbon dioxide cartridge against piercing member to release the gas.

29. The method of claim 28 wherein the moving the rear seat comprises twisting a rear portion of the rear section that is threadably engaged with the remainder of the body, wherein twisting the rear portion engaged in the threads moves the seat forwardly relative to the remainder of the body a sufficient distance to pierce the carbon dioxide cartridge with the seal piercing member.

30. The method of claim 26 wherein the device further comprises a frangible stop to prevent inadvertant screwing of the rear portion.

31. The method of claim 21 wherein the liquid comprises a mixture of an alcohol, water and a soluble red or green dye.

* * * * *